US007833361B2

(12) United States Patent
Saito et al.

(10) Patent No.: US 7,833,361 B2
(45) Date of Patent: Nov. 16, 2010

(54) ALLOY AND METHOD FOR PRODUCING MAGNETIC REFRIGERATION MATERIAL PARTICLES USING SAME

(75) Inventors: Akiko Saito, Kawasaki (JP); Tadahiko Kobayashi, Yokohama (JP); Hideyuki Tsuji, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 333 days.

(21) Appl. No.: 11/858,450

(22) Filed: Sep. 20, 2007

(65) Prior Publication Data

US 2008/0078476 A1 Apr. 3, 2008

(30) Foreign Application Priority Data

Sep. 29, 2006 (JP) ..... P2006-268339

(51) Int. Cl.
*H01F 1/053* (2006.01)
*H01F 1/147* (2006.01)

(52) U.S. Cl. ..... 148/301; 148/302; 148/306; 62/3.1; 62/6

(58) Field of Classification Search ..... None
See application file for complete search history.

(56) References Cited

U.S. PATENT DOCUMENTS 6,676,772 B2 * 1/2004 Saito et al. ..... 148/301
7,168,255 B2 1/2007 Saito et al.
7,186,303 B2 3/2007 Kogure et al.
2006/0213580 A1 9/2006 Tsuji et al.
2006/0231163 A1 * 10/2006 Hirosawa et al. ..... 148/105
2007/0137732 A1 6/2007 Kogure et al.

FOREIGN PATENT DOCUMENTS

| | | | |
|---|---|---|---|
| CN | 1837393 | A | 9/2006 |
| DE | 103 38 467 | A1 | 3/2004 |
| JP | 2004-099928 | * | 4/2004 |
| JP | 2004-99928 | | 4/2004 |
| JP | 2004-100043 | | 4/2004 |
| JP | 2005-113270 | | 4/2005 |
| JP | 2006-265631 | | 10/2006 |

OTHER PUBLICATIONS

Machine Translation of Japanese Patent No. 2004-099928 (Ryosuke).*
U.S. Appl. No. 12/015,812, filed Jan. 17, 2008, Tsuji, et al.
"Magnetic Property of La $(Fe_xSi_{1-x})_{13}$ Based Giant Quantity of Heat Compound Spheroidized by Rotating Electrode Method", Collected Abstracts of the 2006 Autumn Meeting of the Japan Institute of Metals, Sep. 16-18, 2006, No. 139, p. 406.

* cited by examiner

*Primary Examiner*—John P Sheehan
(74) *Attorney, Agent, or Firm*—Oblon, Spivak, McClelland, Maier & Neustadt, L.L.P.

(57) ABSTRACT

An alloy is used for production of magnetic refrigeration material particles. The alloy contains La in a range of 4 to 15 atomic %, Fe in a range of 60 to 93 atomic %, Si in a range of 3.5 to 23.5 atomic % and at lease one element M selected from B and Ti in a range of 0.5 to 1.5 atomic %. The alloy includes a main phase containing Fe as a main component element and Si, and a subphase containing La as a main component element and Si. The main phase has a bcc crystal structure and an average grain diameter of 20 μm or less.

17 Claims, 7 Drawing Sheets

ALLOY AND METHOD FOR PRODUCING MAGNETIC REFRIGERATION MATERIAL PARTICLES USING SAME

CROSS-REFERENCE TO RELATED APPLICATIONS

This application is based upon and claims the benefit of priority from the prior Japanese Patent Application No. 2006-268339 filed on Sep. 29, 2006; the entire contents of which are incorporated herein by reference.

BACKGROUND OF THE INVENTION

1. Field of the Invention

The present invention relates to an alloy and a method for producing magnetic refrigeration material particles using the same.

2. Description of the Related Art

When a magnetic field applied to a certain type of magnetic substance is changed in an adiabatic state, its temperature is changed. This phenomenon is called a magnetocaloric effect. Physically, the degree of freedom of magnetic spins of the magnetic substance is changed by the magnetic field, and the entropy of a magnetic spin system (electron system responsible for (attributed to) magnetism) is changed as a result. With the entropy change, an instantaneous energy transfer occurs between the electron system and a lattice system, resulting in changing the temperature of the magnetic substance. A refrigeration technique using (based on) such a magnetocaloric effect is magnetic refrigeration.

The magnetic refrigeration is expected as environment-conscious (friendly) refrigeration technique because it is chlorofluorocarbon-free and has high energy efficiency. For the magnetic refrigeration in the near room temperature range, an AMR method (Active Magnetic Regenerative Refrigeration) has been proposed as a useful refrigerating method. Besides, a $Gd_5(Ge, Si)_4$ based substance, an MnFe(P, As) based substance, an Mn(As, Sb) based substance, an $La(Fe, Si)_{13}$ based substance and the like have been proposed as materials showing a high magnetocaloric effect in a room temperature range at a low magnetic field.

The $La(Fe, Si)_{13}$ based substance is promising candidate as a magnetic refrigeration material because it provides a large magnetic entropy change in a low magnetic field and is also substantially free from thermal hysteresis. In a case where the $La(Fe, Si)_{13}$ based substance is applied to magnetic refrigeration according to the AMR method, it is desirably used by fabricating into spherical particles for practical use (usage). The $La(Fe, Si)_{13}$ based substance has a problem in a production process of $La(Fe, Si)_{13}$ phase having an $NaZn_{13}$ type crystal structure excelling in magnetocaloric effect (which exhibits large magnetic entropy change).

To produce the $La(Fe, Si)_{13}$ phase, materials such as La, Fe and Si are first prepared at a stoichometric ratio and melted by an arc melting method or a high-frequency melting method. When La and Fe, which are completely non-solid solution systems, are merely undergone a melting process, they are separated into two phases, which are Fe-rich phase and La-rich phase. The former is Fe alloy phase (hereinafter also referred to as α-Fe phase) containing Si and having a bcc crystal structure containing Fe as a main component element. The latter is intermetallic compound phase containing having La as a main component element and Si.

According to a melting process of the arc melting method or the high-frequency melting method, coarse crystal phases of Fe-rich phase and La-rich phase are mutually convoluted and show an intricate metallographic structure. Subsequently, the integrated alloy is subjected to a heat treatment at a temperature of about 900 to 1100° C. for a long period of time to produce gradually $La(Fe, Si)_{13}$ phase by interdiffusion of the elements. Thus, the production process of the $La(Fe, Si)_{13}$ phase using a bulk material by applying an ordinary melting method has drawbacks that it is essential to perform the heat treatment at a relatively high temperature for (long term of) several days to several months.

Meanwhile, JP-A 2004-100043 describes that a liquid quenching method is applied to production of a ribbon-like magnetic refrigeration material in order to eliminate the necessity of a long-term heat treatment in an $La(Fe, Si)_{13}$ phase production process. As described above, since the magnetic refrigeration material is desirably used by fabricating into the spherical particles, the ribbon-like magnetic refrigeration material has a drawback that it has poor practical utility.

JP-A 2004-099928 describes a magnetic refrigeration material containing metalloid elements (B, C and the like). It describes that the addition of the metalloid elements in a range of 1.8 to 5.4 atomic % to the magnetic refrigeration material produces $La(Fe, Si)_{13}$ phase in 75 volume % or more immediately after casting of a molten alloy. But, fabricability into spherical particles and uniformity of the properties among the particles obtained by fabricating into the spherical particles are not taken into consideration.

To apply the $La(Fe, Si)_{13}$ based substance to the magnetic refrigeration, it is necessary to fabricate into practical small pieces (spherical particles or the like). To do so, there are a method of subjecting a mother alloy to the heat treatment to produce the $La(Fe, Si)_{13}$ phase and breaking into small pieces, and a method of breaking a mother alloy into small pieces and subjecting them to the heat treatment to produce the $La(Fe, Si)_{13}$ phase. The former method has a disadvantage that the filling factor of the magnetic refrigeration material lowers depending on the pulverized shapes because the mother alloy undergone the heat treatment is pulverized into small pieces. There is a problem that cracks (cracking) are produced within the small pieces by a stress applied when pulverizing to make them brittle, and the small pieces are finely divided during the magnetic refrigeration operation to disturb the operation.

As a method of breaking an alloy material (mother alloy) into small pieces by melting, an atomizing method, a rotary disc process (RDP) and a rotary electrode process (REP) are generally known. Spherical particles produced by such a method are subjected to a heat treatment to produce $La(Fe, Si)_{13}$ phase, so that the spherical particles (magnetic refrigeration material particles) suitable for magnetic refrigeration can be obtained. Especially, the rotary electrode process capable of producing the spherical particles without involving the mother alloy melting process in a crucible is suitable as a method for producing the spherical particles to apply the $La(Fe, Si)_{13}$ based substance to the magnetic refrigeration. By the rotary electrode process, the particles each close to a spherical shape can be produced efficiently.

However, in a case where the mother alloy produced on the basis of a conventional material composition is applied to the rotary electrode process, the composition ratio of the spherical particles becomes variable because of the coarse two-phase separated state of the mother alloy, and it becomes a cause of degrading the properties of the magnetic refrigeration material particles. When the rotary electrode process is applied to the production of the magnetic refrigeration material particles, raw materials such as La, Fe and Si are prepared at the stoichiometric ratio of $La(Fe, Si)_{13}$, melted by high-frequency melting or the like, and cast by using a mold to produce the mother alloy of an $La(Fe, Si)_{13}$ based substance.

The mother alloy produced based on a conventional material composition has a metallographic structure that the coarse Fe-rich phase and La-rich phase exist together. Where this mother alloy is used to produce spherical particles by the rotary electrode process, the composition of each of the spherical particles becomes variable largely because of the coarse two-phase separated state of the mother alloy. Where the spherical particles are subjected to the heat treatment to produce the magnetic refrigeration material particles having the $La(Fe, Si)_{13}$ phase, there is a difference in generation of the $La(Fe, Si)_{13}$ phase on the basis of the composition variation of the spherical particles, and property variations of the magnetic refrigeration material particles become large. In addition, the generation efficiency of the $La(Fe, Si)_{13}$ phase is also degraded because the interdiffusion of the elements is hard to occur in certain compositions.

The magnetic refrigeration material particles (spherical particles) produced by using the conventional mother alloy have variations in Curie temperature Tc because of the composition variations. Where such spherical particles are charged in a container and applied to the magnetic refrigeration according to the AMR method, an optimum operation temperature (close to Tc) also becomes variable in terms of the magnetocaloric effect because of variations of the Curie temperature Tc among the spherical particles. Thus, a sufficient refrigerating effect cannot be obtained by a thermal cycle test according to the AMR method.

SUMMARY OF THE INVENTION

An alloy according to an aspect of the present invention contains La in a range of 4 atomic % to 15 atomic %, Fe in a range of 60 atomic % to 93 atomic %, Si in a range of 3.5 atomic % to 23.5 atomic % and at least one element M selected from B and Ti in a range of 0.5 atomic % to 1.5 atomic %, and includes a main phase containing Fe as a main component element and Si, and a subphase containing La as a main component element and Si, the main phase having a bcc crystal structure and an average grain diameter of 20 μm or less.

A method for producing magnetic refrigeration material particles according to another aspect of the present invention includes, melting partially with plasma the alloy material according to the aspect of the present invention; separating the melted alloy into small pieces in a molten state; spheroidizing the melted alloy separated into the small pieces by the surface tension in an atmosphere; solidifying the spheroidized small pieces in an atmosphere; and performing a heat treatment of the solidified small pieces.

DETAILED DESCRIPTION OF THE INVENTION

Figure 1:
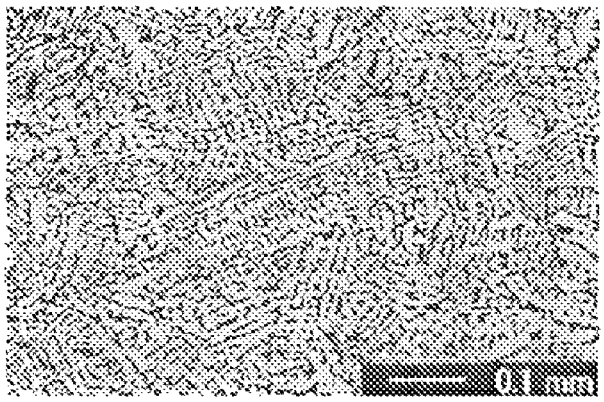
FIG. 1 is a photograph showing a magnified metallographic structure of a mother alloy according to Example 1.

Modes of conducting the present invention are described below with reference to the drawings. An alloy according to an embodiment of the present invention contains La in a range of 4 to 15 atomic %, Fe in a range of 60 to 93 atomic %, Si in a range of 3.5 to 23.5 atomic %, and at least one element M selected from B and Ti in a range of 0.5 to 1.5 atomic % (a total amount of the components is determined to be 100 atomic %).

The alloy of this embodiment is not a magnetic refrigeration material itself but a mother alloy (alloy material) which is used for production of magnetic refrigeration material particles. Therefore, the metallographic structure of the alloy is separated to two phases, namely a main phase (Fe-rich phase) containing Fe as a main component element and Si, and a subphase (La-rich phase) containing La as main component element and Si. The main phase has a bcc crystal structure.

The main phase has the largest volume occupancy with respect to a total amount of all crystal phases and amorphous phases configuring the alloy. The alloy of this embodiment has as the main phase the bcc crystal phase (Fe-rich phase) containing Fe as the main component element and Si. The ratio of the main phase (Fe-rich phase) is preferably 55 volume % or more, and more preferably 60 volume % or more. The main phase which is composed of the Fe-rich phase has an average grain diameter of 20 μm or less. In other words, the alloy has a metallographic structure which is separated into two very fine phases.

The alloy (mother alloy) of this embodiment contains La, Fe and Si in the above-described ranges in order to produce magnetic refrigeration material particles including $La(Fe, Si)_{13}$ phase having an $NaZn_{13}$ type crystal structure using it. If the content of La is less than 4 atomic % or exceeds 15 atomic %, the production of the magnetic refrigeration material particles using the alloy (mother alloy) results in degradation of generation efficiency of the $La(Fe, Si)_{13}$ phase. The La content is more preferably in a range of 6 to 12 atomic %, and most preferably in a range of 7 to 10 atomic %. Part (1 atomic % or less with respect to the entire alloy composition) of La may be substituted by a rare-earth element such as Ce, Pr, Nd or the like.

The generation efficiency of the $La(Fe, Si)_{13}$ phase is also degraded if the Fe content is less than 60 atomic % or exceeds 93 atomic %. The Fe content is preferably in a range of 75 to 90 atomic %. Part (10 atomic % or less of the entire alloy composition) of Fe may be substituted by at least one element selected from Co, Ni and Mn. The element used to substitute Fe is preferably Co. The alloy of this embodiment contains preferably Co in a range of 10 atomic % or less with respect to the entire alloy composition. Thus, corrosion resistance and controllability of magnetic property is improved. The Co content is preferably in a range of 2 to 10 atomic %.

If the Si content is less than 3.5 atomic %, the generation efficiency of $La(Fe, Si)_{13}$ phase is degraded significantly, and if it exceeds 23.5 atomic %, the properties of the magnetic refrigeration material particles such as magnetic entropy changes are degraded. The Si content is preferably 4 atomic % or more. When the Si content is 15 atomic % or less, lowering of the mechanical strength due to the addition of B can be suppressed, and applicability to the rotary electrode process is improved. In this respect, the Si content is more preferably 15 atomic % or less. Part (2 atomic % or less with respect to the entire alloy composition) of Si may be substituted by Al.

The alloy material (mother alloy) of this embodiment contains at least one element M selected from B and Ti in a range of 0.5 to 1.5 atomic % in addition to the individual elements (La, Fe and Si) contributing to the generation of the $La(Fe, Si)_{13}$ phase. Inclusion of the element M in a small amount enables to miniaturize the metallographic structure which is separated into two phases of main phase (Fe-rich phase) and subphase (La-rich phase) of the alloy. Specifically, the main phase (Fe-rich phase) can be determined to have an average grain diameter of 20 μm or less. The alloy is allowed to contain unavoidable impurities such as P, Ca, C, O, (Al, Si, Fe) and the like.

In a case where the mother alloy is produced by preparing materials such as La, Fe and Si to have a desired $La(Fe, Si)_{13}$ composition and integrating by an ordinary melting method such as the arc melting method or the high-frequency melting method, a metallographic structure separated into two phases of Fe-rich phase and La-rich phase is generated. The mother alloy having the conventional $La(Fe, Si)_{13}$ composition causes large composition segregation because of coarse Fe-rich phase and La-rich phase, so that the composition ratio is variable depending on arbitrary positions. Therefore, when the mother alloy is divided into small pieces (magnetic refrigeration material particles) having a size of the phase-separated metallographic structure, there is a problem that the individual small pieces have different compositions.

Where the size of the phase-separated metallographic structure of the mother alloy is fine enough with respect to the sizes of the small pieces, or the composition of the arbitrary area with the size of the small pieces of the mother alloy is originally uniform, the variations of the compositions of the small pieces can be decreased when the mother alloy is divided into small pieces. In other words, the compositional homogeneity of the small pieces can be enhanced. However, the ordinary melting process cannot avoid the phase separation into the Fe-rich phase and the La-rich phase in a solidification process. Therefore, it is significant to suppress the phase-growth of the individual phases in the mother alloy solidification process and to miniaturize the metallographic structure which was separated to the Fe-rich phase and the La-rich phase.

In this respect, the alloy (mother alloy) of this embodiment for production of the magnetic refrigeration material particles contains a small amount of at lest one element M selected from B and Ti to suppress the grain growth of the Fe-rich phase and the La-rich phase in the solidification process. In addition, the contained element M is effective to keep good magnetocaloric properties. Therefore, the alloy (mother alloy) of this embodiment contains the element M in a range of 0.5 to 1.5 atomic %.

When the content of the element M is less than 0.5 atomic % in the alloy (mother alloy) used for production of the magnetic refrigeration material particles, the effect of suppressing the grain growth of the Fe-rich phase and the La-rich phase in the solidification process becomes unsatisfactory. In this case, the composition segregation of the mother alloy cannot be suppressed sufficiently. The content of the element M is preferably 0.9 atomic % or more.

If the content of the element M exceeds 1.5 atomic %, generation of unnecessary phases such as $Fe_2B$ and $Fe_2Ti$ becomes prominent, and the properties of the magnetic refrigeration material particles produced by applying the rotary electrode process to the alloy (mother alloy) are degraded. The content of the element M is more preferably 1.2 atomic % or less. In addition, if the content of the element M is excessively large, the mechanical strength is lowered, and the application to the rotary electrode process becomes difficult. The content of the element M is determined to be an amount effective for suppression of the phase growth in the solidification process and in a range not adversely affecting on the properties and mechanical strength of the magnetic refrigeration material particles.

As described above, the alloy (mother alloy) having a phase-separated texture (mainly fine two-phase separated texture), that the main phase has an average grain diameter of 20 μm or less, is split into particles (small pieces) to enable to suppress the composition variations among the particles (small pieces). If the main phase has an average grain diameter of exceeding 20 μm, the composition segregation of the mother alloy becomes large, and the composition variations among the particles cannot be suppressed sufficiently. The average grain diameter of the main phase of the mother alloy is more preferably 15 μm or less. And, the obtained particles are subjected to the heat treatment to generate $La(Fe, Si)_{13}$ phase, and it becomes possible to obtain magnetic refrigeration material particles excelling in the uniformity of the phase structure and properties.

The shape of the alloy of this embodiment is not limited to a particular shape. In a case where the alloy of this embodiment is used as a mother alloy to produce magnetic refrigeration material particles by applying, for example, the rotary electrode process, it is preferable that the mother alloy has a cylindrical shape. The mother alloy has preferably a cylindrical shape having a diameter of 10 mm or more and a length of 100 mm or more. The mother alloy having such a cylindrical shape of large bulk tends to cause composition segregation because a quenching effect is hardly produced when casting, but the alloy of this embodiment can provide a fine two-phase separated texture by virtue of the element M added in a small amount.

The alloy having as the main phase the Fe-rich phase with the bcc crystal structure has excellent fabricability and good mechanical strength, so that the mother alloy can be machined easily into a cylindrical shape. Its thread cutting and the like can also be performed suitably. It can also be applied without any problem to a process of the rotary electrode process that the mother alloy is fixed to a jig and rotated at a rotation speed of about several thousand to ten thousand rotations/min. The mother alloy containing many $La(Fe, Si)_{13}$ phase is brittle and cannot bear enough the process of the rotary electrode process. For example, the mother alloy tends to have a problem that it is easily cracked when fixed to a device or fractured to scatter when rotated and exposed to plasma.

A method for producing magnetic refrigeration material particles according to an embodiment of the invention is described below. The method for producing according to this embodiment produces the magnetic refrigeration material particles by applying, for example, the rotary electrode process. For that, the alloy of the embodiment described above is used as a mother alloy for the rotary electrode process. The rotary electrode process can efficiently produce spherical particles each close to a true spherical shape.

In addition, the rotary electrode process has an advantage that it can produce spherical particles without melting in a crucible as the atomizing process or the rotary disc process, and degradation of properties by contamination due to the reaction with the crucible is not caused. Since the atomizing process and the rotary disc process use the crucible, there is a possibility that the molten alloy reacts with the crucible to degrade the properties by taking contamination in the alloy. Especially, La is active against oxidative reaction. On the other hand, the rotary electrode process does not use a crucible, so that the degradation of the properties due to the reaction with the crucible is not caused. Therefore, it is desirable to use the rotary electrode process for the production process of the magnetic refrigeration material particles.

First, the alloy material of the above-described embodiment is used as a mother alloy, fabricated into a cylindrical shape and fixed to a jig. As described above, the alloy has excellent fabricability and good mechanical strength, and when the rotary electrode process is applied, it can be machined easily into the cylindrical shape which is a practically used shape of the mother alloy. It can also be applied without any problem to the rotary electrode process that the mother alloy is fixed to a jig and rotated at a rotation speed of about several thousand to ten thousand rotations/min.

The mother alloy is then partially melted by plasma to produce a molten alloy. The molten alloy is separated into small pieces in the molten state. In the production of the molten alloy and the separation process into the small pieces, the mother alloy is partially melted by plasma while being rotated and separated by centrifugal force into the small pieces in the molten state. The molten alloy separated into the small pieces is spheroidized by surface tension in an atmosphere, and the spheroidized small pieces are solidified in an atmosphere to produce spherical particles.

The above processes are performed to produce spherical particles having, for example, a diameter of about 0.3 to 1.2 mm. At this stage, the produced spherical particles have mainly two-phase separated texture of fine Fe-rich phase and La-rich phase similar to the mother alloy in morphology, but finer than the mother alloy. In other words, the spherical particles just produced by the rotary electrode process do not contain a sufficient amount of $La(Fe, Si)_{13}$ phase for practical use and are composed of substantially very fine Fe-rich phase and La-rich phase.

The spherical particles produced by the rotary electrode process are subjected to a heat treatment to generate phase ($La(Fe, Si)_{13}$ phase) having an $NaZn_{13}$ type crystal structure so as to produce magnetic refrigeration material particles. The heat treatment of the spherical particles is preferably performed in a vacuum atmosphere substituted by an inert gas such as Ar under conditions of temperatures of 900 to 1100° C. for 12 to 240 hours.

If the heat treatment temperature is less than 900° C., interdiffusion of elements hardly occurs, and the generation efficiency of the $La(Fe, Si)_{13}$ phase is degraded. If the heat treatment temperature exceeds 1100° C., the Fe-rich phase having the bcc crystal structure is stabilized, and the generation efficiency of the $La(Fe, Si)_{13}$ phase is degraded considerably. If the heat treatment time is less than 12 hours, the $(Fe, Si)_{13}$ phase cannot be obtained satisfactorily. Even if the heat treatment is performed more than 240 hours, no further effect can be obtained.

In a case where the rotary electrode process is applied to a mother alloy having a coarse metallographic structure and large composition segregation to produce spherical particles, variations of the composition of each of the particles become large. The variations of the composition of each of the spherical particles become a cause of generation of variations in properties and a phase composition of the magnetic refrigeration material particles produced using it. In addition, if the composition segregation is large in the small particles, interdiffusion of Fe and La does not occur easily while the heat treatment, and the heat treatment for generation of the $La(Fe, Si)_{13}$ phase requires a longer time (it takes more long time to generate the $La(Fe, Si)_{13}$ phase). Moreover, there is a possibility that the phase composition cannot be made uniform even if a long time is taken.

In this respect, the alloy (mother alloy) of the above-described embodiment has a fine metallographic structure (mainly fine two-phase separated texture) that the main phase has an average grain diameter of 20 μm or less, so that variations of the composition of each of the spherical particles produced by applying the rotary electrode process can be decreased considerably. The composition segregation within the particles can also be suppressed on the basis of the fine metallographic structure of the alloy (mother alloy). Thus, interdiffusion of Fe and La by the heat treatment becomes easy.

Therefore, the magnetic refrigeration material particles including many $La(Fe, Si)_{13}$ phase having the $NaZn_{13}$ type crystal structure as a final form can be obtained efficiently. Where the magnetic refrigeration material particles are charged in a container and applied to the magnetic refrigeration according to the AMR method, variations of the Curie temperature Tc among the particles are small. Thus, variations of an optimum operation temperature (close to Tc) in connection with the magnetocaloric effect become small, and it becomes possible to obtain a satisfactory refrigerating effect.

Specific examples and evaluated results according to the present invention are described below.

Example 1 and Comparative Example 1

As Comparative Example 1, materials La, Fe, Co and Si were mixed at a stoichiometric ratio (atomic %) of 7.15:78.46:6.96:7.43. Meanwhile, as Example 1, materials La, Fe, Co, Si and B were mixed at a stoichiometric ratio (atomic %) of 7.15:78.46:6.96:6.50:0.93. The material mixtures each were melted in a high-frequency melting furnace, and each molten metal was cast in a mold to produce a cylindrical mother alloy (alloy for production of magnetic refrigeration material particles). The produced mother alloys were determined to have a cylindrical shape having a diameter of 50 mm and a length of 220 mm.

The individual mother alloys of Example 1 and Comparative Example 1 were examined for the generated phases by X-ray diffraction to confirm that they each had as a main phase Fe alloy phase (α-Fe phase) having a bcc crystal structure. It was also confirmed by performing EPMA analysis that the main phases included Fe-rich phase containing Fe, Co and Si. It was found that the subphases included La-rich phase containing La and Si and La-rich phases containing La, Si and Co.

Figure 2:
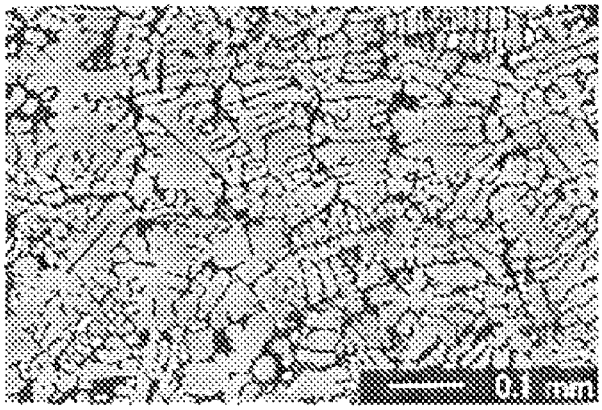
FIG. 2 is a photograph showing a magnified metallographic structure of a mother alloy according to Comparative Example 1.

FIG. 1 and FIG. 2 show results (cross-section observation photographs) obtained by observing the metallographic structures of the individual mother alloys according to Example 1 and Comparative Example 1 through an optical polarization microscope. In FIG. 1 and FIG. 2, whitish bright portion is the Fe-rich phase, and gray dark portion is the La-rich phase. As apparent from FIG. 1 and FIG. 2, they show metallographic structures that the Fe-rich phase as the main phase and the La-rich phase as the subphase are convoluted mutually like a dendritic structure. The main phase of Comparative Example 1 had a grain diameter of about several tens μm, while that of Example 1 had a grain diameter of approximately several μm to 10 μm. The area ratio of the main phase was determined from the individual cross-section observation photographs to find that the main phases each had the area ratio, which corresponded with the volume ratio, of 70% or more.

Figure 3:
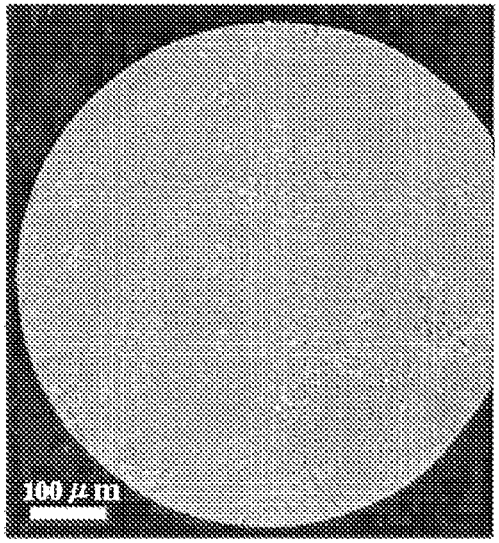
FIG. 3 is a photograph showing a magnified metallographic texture of a spherical particle produced by using the mother alloy of Example 1.
Figure 4:
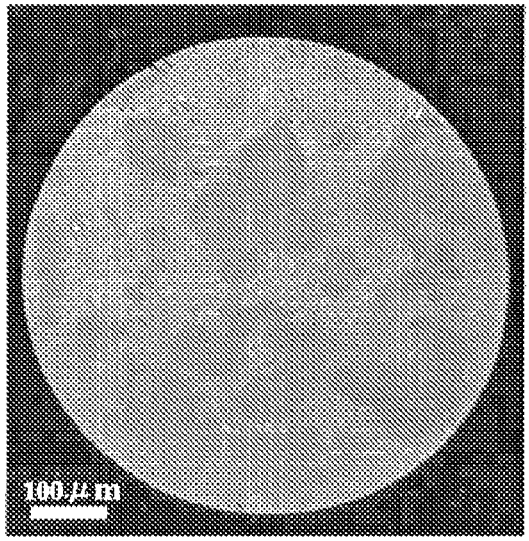
FIG. 4 is a photograph showing a magnified metallographic texture of a spherical particle produced by using the mother alloy of Comparative Example 1.

The cylindrical mother alloys were used to produce spherical particles having a particle size of the order of 500 μm by the rotary electrode process. FIG. 3 and FIG. 4 show cross-section observation photographs (SEM composition images) of the individual spherical particles according to Example 1 and Comparative Example 1. In FIG. 3 and FIG. 4, whitish bright portion is La-rich phase, and gray dark portion is Fe-rich phase (opposite to FIG. 1 and FIG. 2). The spherical particles shown in FIG. 3 and FIG. 4 of both Example 1 and Comparative Example 1 have a finer structure in comparison with the mother alloys shown in FIG. 1 and FIG. 2.

It is seen from the two-phase separated textures of the spherical particles shown in FIG. 3 and FIG. 4 that distribution of the two-phase structure of Example 1 is relatively uniform. Meanwhile, it is seen that the distribution of the two-phase structure of Comparative Example 1 is largely unbalanced depending on positions, and composition segregation of La and Fe is large. In addition, each of all spherical particles of Example 1 has a metallographic structure with a relatively high uniformity similar to that of the texture shown in FIG. 3. Meanwhile, most of spherical particles of Comparative Example 1 were recognized having large composition segregation depending on positions within the particle as shown in FIG. 4. Moreover, each particles has a different component ratio of the La-rich phases and the Fe-rich phases.

Then, the individual spherical particles of Example 1 and Comparative Example 1 were vacuum-encapsulated and subjected to a heat treatment at a temperature of about 1060° C. for about one week. After the heat treatment, the individual spherical particles were examined for the generated phases by X-ray diffraction to confirm that the spherical particles of Example 1 had $NaZn_{13}$ type crystal phase as the main phase, and a main peak intensity ratio of X-ray was 70% or more in comparison with the α-Fe phases. Meanwhile, the spherical particles of Comparative Example 1 were confirmed that the α-Fe phase and the $NaZn_{13}$ type crystal phase had a nearly equal main peak intensity ratio of X-ray, or the α-Fe phase had a higher main peak intensity ratio (that the intensities of main peak on the X-ray diffraction correspond to the α-Fe phase and the $NaZn_{13}$ type crystal phase were nearly equal, or that correspond to the α-Fe phase was higher than that correspond to the $NaZn_{13}$ type crystal phase). Thus, it was found that the generation of the $NaZn_{13}$ type crystal phase in Comparative Example 1 did not proceed beyond a prescribed level.

Figure 5:
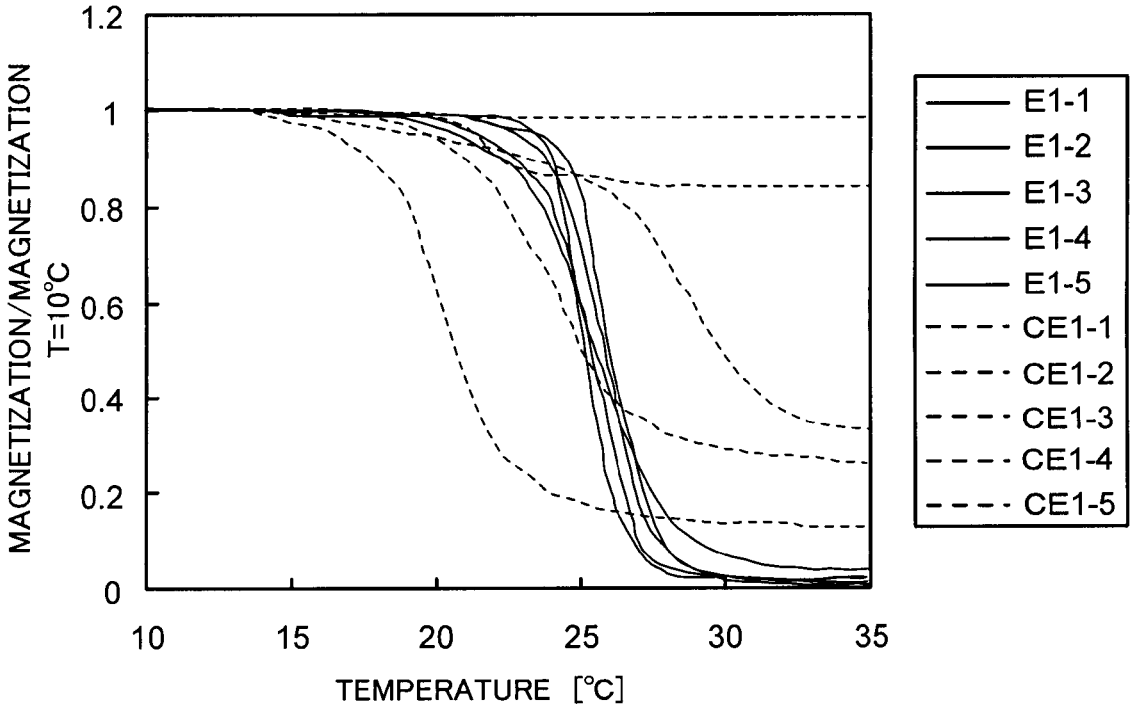
FIG. 5 is a diagram showing the temperature dependence of magnetization of the spherical particles according to Example 1 and Comparative Example 1.

In addition, five particles arbitrarily selected from the spherical particles of Example 1 and Comparative Example 1 were measured for temperature dependence of magnetization (the temperature dependence of magnetization of each of the five particles which is arbitrarily selected from the spherical particles of Example 1 and Comparative Example 1 were measured). The results are shown in FIG. 5. It is seen from the measured results of magnetization that Comparative Example 1 includes particles substantially formed of α-Fe phases only, and variations of Tc (optimum operation temperature) due to the composition variations of the individual particles is considerable. It is also confirmed that the composition variations of the individual particle in Example 1 were decreased substantially in comparison with Comparative Example 1, and variations of Tc (optimum operation temperature) due to the compositional homogeneity were small.

Next, about one gram each was collected from the spherical particles of Example 1 and Comparative Example 1 and charged in a small container to prevent the particles from moving. Then, the container was set on a test device, and the application and removal of a magnetic field to and from the entire container were repeated (the procedure of applying and removing a magnetic field to and from the entire container including the spherical particles were repeated), and the spherical particles in the container were observed for a temperature change (the temperature changes of the spherical particles in the container were observed with repeating procedure). As a result, the temperature change was repeated in both Example 1 and Comparative Example 1, namely the application of the magnetic field increased the temperatures of the spherical particles, and the removal of the magnetic field decreased the temperatures (the temperature of the spherical particles increase while applying a magnetic field to the container, meanwhile the temperature of the spherical particles decrease while removing a magnetic field from the container). The observations were performed under the same conditions of magnetic field changing procedure.

Figure 6:
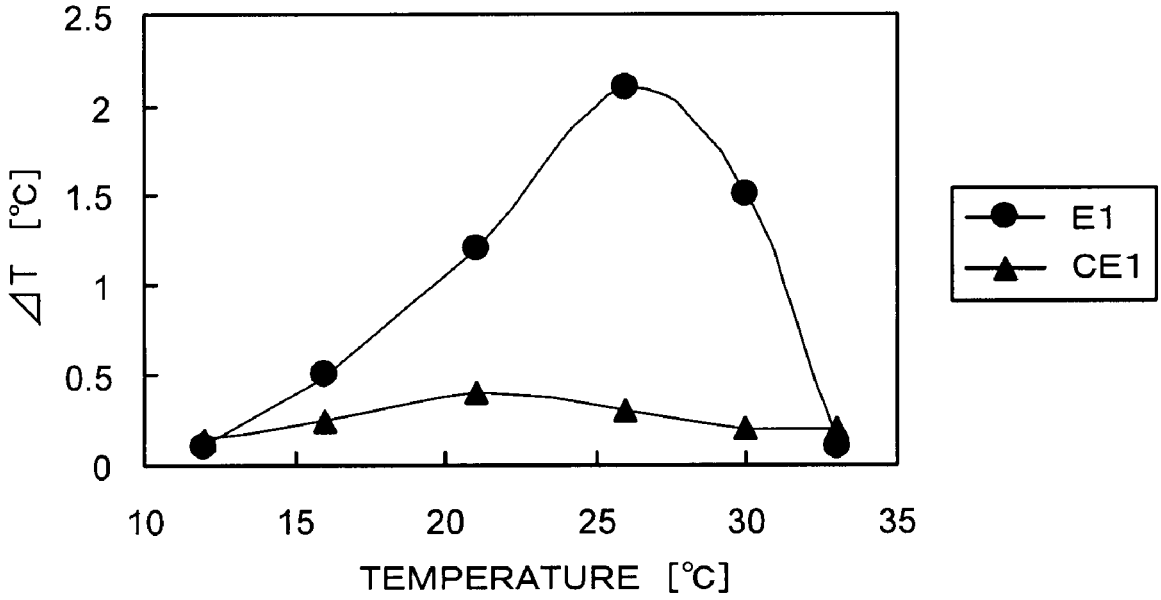
FIG. 6 is a diagram showing changes of ΔT when ambient temperatures of the spherical particles according to Example 1 and Comparative Example 1 are changed.

The magnitude of a temperature change of the spherical particles accompanied by the magnetic field change was determined as ΔT, and ΔT was measured with various ambient temperature. The results are shown in FIG. 6. It is apparent from FIG. 6 that when the environmental temperature was about 26° C. in Example 1, the maximum value (ΔTmax) of ΔT was 2.1° C. (that the maximum value of ΔT (ΔTmax) was 2.1° C. at the ambient temperature of about 26° C. in Example 1). Satisfactory ΔT could not be obtained at any environmental temperature in Comparative Example 1 in comparison with Example 1 (Comparative Example 1 is of much lower ΔT than Example 1 at any ambient temperature). It is considered that large ΔT could not be obtained for the particles in Comparative Example 1 in comparison with Example 1 because of the variations of Tc (optimum operation temperature) due to the composition variations of the individual particles.

Example 2 and Comparative Example 2

As Comparative Example 2, materials La, Fe, Co and Si were mixed at a stoichiometric ratio (atomic %) of 7.15:79.85:1.86:11.14. As Example 2, materials La, Fe, Co, Si and Ti were mixed at a stoichiometric ratio (atomic %) of 7.15:78.92:1.86:11.14:0.93. The material mixtures each were melted in a high-frequency melting furnace, and each molten metal was cast in a mold to produce a similar cylindrical mother alloy as in Example 1.

The individual mother alloys of Example 2 and Comparative Example 2 were examined for the generated phases by X-ray diffraction to confirm that they each had as the main phase Fe alloy phase (α-Fe phase) having the bcc crystal structure. It was also confirmed by performing EPMA analysis that the main phases included Fe-rich phase containing Fe, Co and Si. It was found that the subphases included La-rich phases containing La, Si and Co and La-rich phases containing La and Si.

Figure 7:
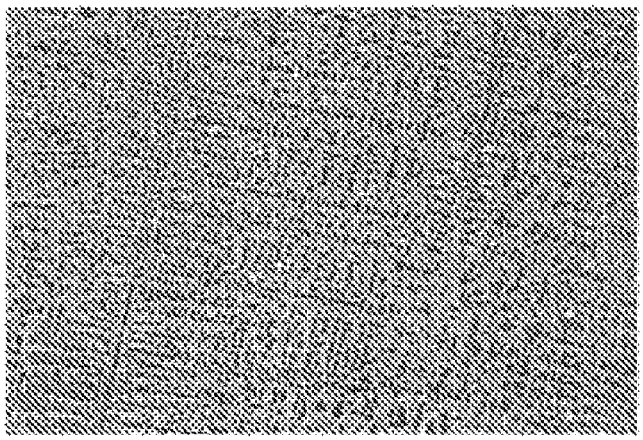
FIG. 7 is a photograph showing a magnified metallographic structure of a mother alloy according to Example 2.
Figure 8:
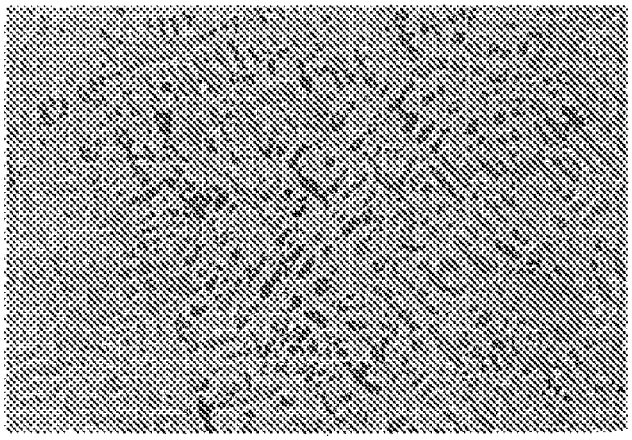
FIG. 8 is a photograph showing a magnified metallographic structure of a mother alloy according to Comparative Example 2.

FIG. 7 and FIG. 8 show the results (cross-section observation photographs) obtained by observing the metallographic structures of the individual mother alloys according to Example 2 and Comparative Example 2 through an optical polarization microscope. As shown in FIG. 7 and FIG. 8, the main phase had an average grain diameter of about several ten μm in Comparative Example 2, while that of Example 2 had a grain diameter of approximately several μm. The area ratio of the main phases was determined from the individual cross-section observation photographs to find that the main phases each had the area ratio, which corresponded with the volume ratio, of 60% or more.

The mother alloys were used to produce spherical particles having a particle size of the order of 500 μm by the rotary electrode process. As a result, good spherical particles having less composition segregation were obtained in Example 2 that the mother alloy had a fine metallographic structure in the same manner as in Example 1. Meanwhile, in Comparative Example 2 that the mother alloy had a large metallographic structure, the component ratio of the La-rich phase and the Fe-rich phase was largely different among the individual spherical particles. When the individual spherical particles were subjected to a heat treatment under the same conditions as in Example 1, the similar results were obtained as in Example 1 and Comparative Example 1.

Figure 9:
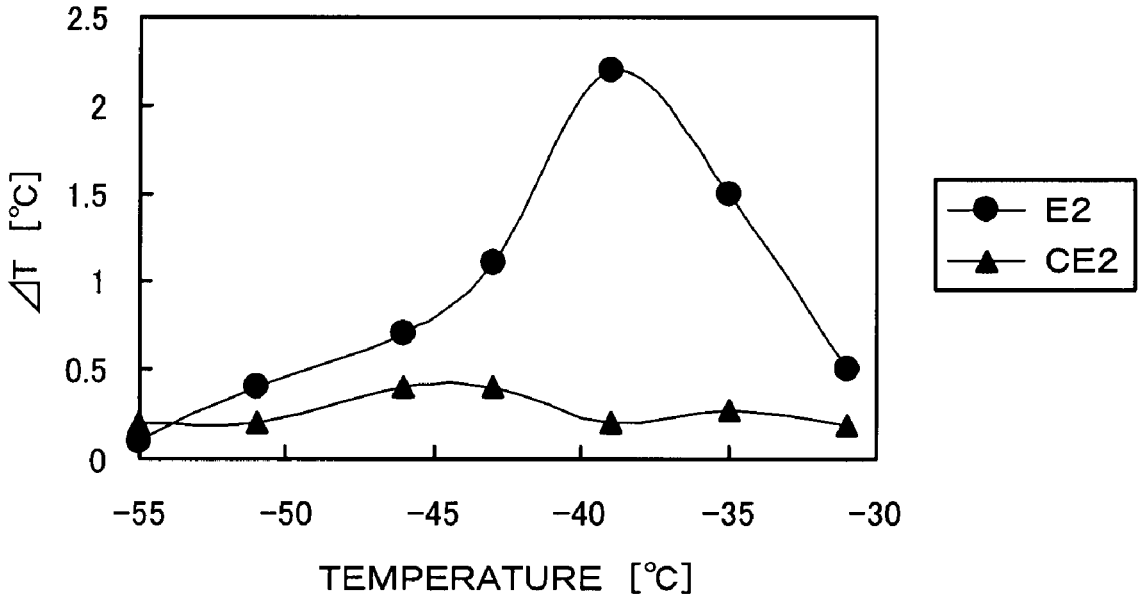
FIG. 9 is a diagram showing changes of ΔT when ambient temperatures of the spherical particles according to Example 2 and Comparative Example 2 are changed.

In addition, about one gram each was collected from the spherical particles of Comparative Example 2 and Example 2 and charged in a small container, and the procedure of applying and removing a magnetic field to and from the container including the spherical particles were repeated. The magnitude ΔT of a temperature change of the spherical particles accompanied by the magnetic field change was measured with various ambient temperature. The results are shown in FIG. 9. When the environmental temperature was about −39° C. in Example 2, the maximum value (ΔTmax) of ΔT was 2.2° C. (in Example 2, the maximum value of ΔT (ΔTmax) was 2.2° C. at the ambient temperature of about −39° C.). On the other hand, ΔTmax in Comparative Example 2 was about 0.4° C.

Example 3 and Comparative Example 3

As Comparative Example 3, materials La, Fe, Si and B were mixed at a stoichiometric ratio (atomic %) of 7.15:79.85:11.14:1.86. As Example 3, materials La, Fe, Si and B were mixed at a stoichiometric ratio (atomic %) of 7.15:80.78:11.14:0.93. The material mixtures each were melted in a high-frequency melting furnace, and each molten alloy was cast in a mold to produce a cylindrical mother alloy. The individual mother alloys were examined for the generated phases by X-ray diffraction to confirm that the main phases were α-Fe phases. It was found in Comparative Example 3 that $NaZn_{13}$ type crystal phase were generated though its generation ratio with respect to the α-Fe phase was small.

Figure 10:
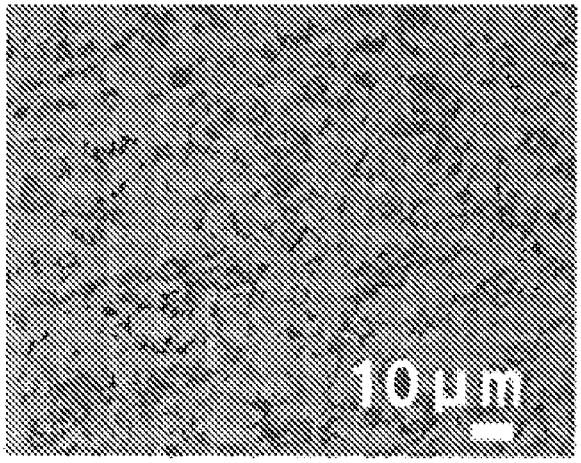
FIG. 10 is a photograph showing a magnified metallographic structure of a mother alloy according to Example 3.
Figure 11:
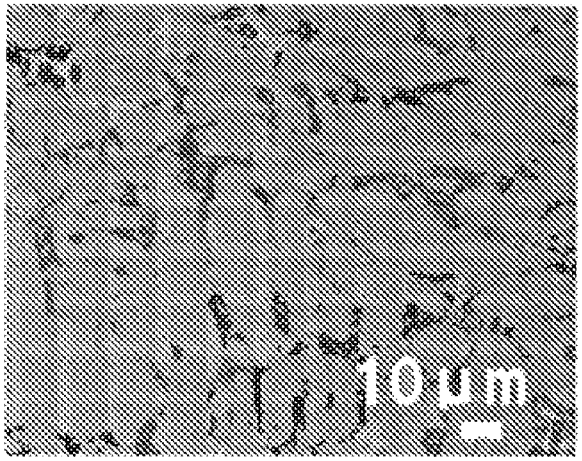
FIG. 11 is a photograph showing a magnified metallographic structure of a mother alloy according to Comparative Example 3.

FIG. 10 and FIG. 11 show the results (cross-section observation photographs) obtained by observing the metallographic structures of the individual mother alloys according to Example 3 and Comparative Example 3 through an optical polarization microscope. As shown in FIG. 10 and FIG. 11, the main phase of Comparative Example 3 had an average grain diameter of about several ten μm, while that of Example 3 was about several μm. The area ratios of the main phases were determined from the individual cross-section observation photographs to find that the main phases each had the area ratio, which corresponded with the volume ratio, of 70% or more.

The mother alloy of Comparative Example 3 was subjected to an EPMA analysis to confirm that the main phase were Fe-rich phase containing Fe and Si. It was also confirmed that Fe-rich phase containing Fe, La and Si and La-rich phase containing La and Si were generated as subphases. The Fe-rich phase (subphase) containing La and Si detected by the EPMA analysis are considered corresponding to the $NaZn_{13}$ type crystal phase confirmed by the X-ray diffraction. Presence of a very small amount of B was found in both phases by the EPMA analysis, but since the absolute amount was so small that it was hard to determine the magnitude of a B content of the individual phases.

Subsequently, the cylindrical mother alloy of Comparative Example 3 was used to produce spherical particles by the rotary electrode method. But, the mother alloy itself was broken into several bulks of large masses and dropped down to chamber without melting while the production process of the rotary electrode method, and only a small amount of spherical particles was obtained. Such an accident in the production process according to the rotary electrode process was also happened in another composition when the B content was large. Thus, the rotary electrode process was not suitable for generating of spherical particles in the case of the composition containing a large amount of B.

With the B content, there was a tendency that the mother alloy became more brittle, and a tendency of enhancement of generation of the $NaZn_{13}$ type crystal phase in the mother alloy was observed. Therefore, when the generated amount of the $NaZn_{13}$ type crystal phase in the mother alloy is increased, it is considered that mechanical strength and resistance to thermal shock are adversely affected in the production process of spherical particles according to the rotary electrode process.

Example 4 to 6 and Comparative Examples 4 to 7

Cylindrical mother alloys (alloys for production of magnetic refrigeration material particles) were produced in the same manner as in Example 1 except that the compositions shown in Table 1 were used. It was confirmed that the individual mother alloys of Examples 4 to 6 had the Fe alloy phases having a bcc crystal structure as the main phase. The cylindrical mother alloys were used to produce spherical particles in the same manner as in Example 1, and the heat treatment was performed under nearly the same conditions as in Example 1.

The magnitudes ΔT were measured with the various ambient temperature of the individual spherical particles. Maximum values (ΔTmax) of ΔT are also shown in Table 1. The mother alloy itself of Comparative Example 8 was broken into large bulks in the production process of the spherical particles according to the rotary electrode method and dropped in the same manner as in Comparative Example 3, and satisfactory spherical particles could not be obtained.

TABLE 1

| | Alloy composition (atomic %) | | | | | | |
|---|---|---|---|---|---|---|---|
| | La | Fe | Co | Si | B | Ti | ΔTmax |
| E1 | 7.15 | 78.46 | 6.96 | 6.50 | 0.93 | — | 2.1 |
| CE1 | 7.15 | 78.46 | 6.96 | 7.43 | — | — | 0.4 |
| E2 | 7.15 | 78.92 | 1.86 | 11.14 | — | 0.93 | 2.2 |
| CE2 | 7.15 | 79.85 | 1.86 | 11.14 | — | — | 0.4 |
| E3 | 7.15 | 80.78 | 0 | 11.14 | 0.93 | — | 2.4 |
| CE3 | 7.15 | 79.85 | 0 | 11.14 | 1.86 | — | (B) |
| CE4 | 7.15 | 78.46 | 6.96 | 6.97 | 0.46 | — | 0.5 |
| E4 | 7.15 | 78.47 | 6.95 | 6.03 | 1.40 | — | 1.8 |
| CE5 | 7.15 | 78.46 | 6.96 | 5.57 | 1.86 | — | 0.5 |
| CE6 | 7.15 | 80.78 | 4.64 | 6.97 | 0.46 | — | 0.3 |
| E5 | 7.15 | 80.78 | 4.64 | 6.50 | 0.93 | — | 1.5 |
| CE7 | 7.15 | 77.07 | 6.50 | 9.28 | — | — | 0.4 |
| E6 | 7.15 | 77.07 | 6.50 | 8.35 | 0.93 | — | 1.7 |
| CE8 | 7.15 | 77.07 | 4.64 | 9.28 | 1.86 | — | (B) |

E = Example,
CE = Comparative Example.
B: Broken in processing.

Examples 7 to 10

Cylindrical mother alloys were produced in the same manner as in Example 1 excepting that the compositions shown in Table 2 were applied. The individual mother alloys of Examples 7 to 10 were confirmed to have the Fe alloy phases having the bcc crystal structure as the main phase. The mother alloys were used to produce spherical particles in the same manner as in Example 1, and the heat treatment was performed under the nearly same conditions (about 980 to 1080° C.) as in Example 1. The magnitudes ΔT were measured with the ambient temperatures of the individual spherical particles changed. Maximum values (ΔTmax) of ΔT are shown in Table 2.

TABLE 2

| | Alloy composition (atomic %) | | | | | | | | | | |
|---|---|---|---|---|---|---|---|---|---|---|---|
| | La | Ce | Pr | Fe | Co | Mn | Ni | Al | Si | B | ΔTmax |
| E7 | 6.45 | 0.7 | — | 76.14 | 7.43 | — | — | — | 8.35 | 0.93 | 1.7 |
| CE9 | 6.45 | 0.7 | — | 76.14 | 7.43 | — | — | — | 9.28 | — | 0.5 |
| E8 | 6.94 | — | 0.2 | 74.27 | 9.3 | — | 0.93 | — | 7.43 | 0.93 | 1.4 |
| CE10 | 6.94 | — | 0.2 | 74.27 | 9.3 | — | 1.86 | — | 7.43 | — | 0.4 |
| E9 | 7.15 | — | — | 74.29 | 7.89 | 0.93 | 0.93 | — | 7.43 | 1.38 | 1.3 |
| CE11 | 7.15 | — | — | 74.28 | 7.89 | 0.93 | 0.93 | — | 8.82 | — | 0.6 |
| E10 | 7.15 | — | — | 74.29 | 7.89 | — | — | 9.29 | — | 1.38 | 1.3 |
| CE12 | 7.15 | — | — | 74.27 | 9.29 | — | — | 9.29 | — | — | 0.3 |

E = Example,
CE = Comparative Example.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An alloy comprising La in a range of 4 to 15 atomic %, Fe in a range of 60 to 93 atomic %, Si in a range of 3.5 to 23.5 atomic % and at least one element M selected from B and Ti in a range of 0.5 to 1.5 atomic %, wherein the alloy comprises 55 volume % or more of a main phase which comprises α-Fe phase comprising Si, and a subphase which comprises intermetallic compound phase comprising La as a main component element and Si, and the main phase has a bcc crystal structure and an average grain diameter of 20 μm or less.

2. The alloy according to claim 1, wherein the Fe is partially replaced by at least one element selected from Co, Ni and Mn.

3. The alloy according to claim 2, wherein the alloy comprises Co in 10 atomic % or less.

4. The alloy according to claim 1, wherein the La is partially replaced by at least one element selected from Ce, Pr and Nd.

5. The alloy according to claim 1, wherein the alloy comprises La in a range of 6 to 12 atomic %.

6. The alloy according to claim 1, wherein the alloy comprises Fe in a range of 75 to 90 atomic %.

7. The alloy according to claim 1, wherein the alloy comprises Si is contained in a range of 4 to 15 atomic %.

8. The alloy according to claim 1, wherein the alloy comprises element M in a range of 0.9 to 1.2 atomic %.

9. The alloy according to claim 1, wherein the alloy has a cylindrical shape.

10. The alloy according to claim 1, wherein the alloy has a cylindrical shape having a diameter of 10 mm or more and a length of 100 mm or more.

11. A method for producing magnetic refrigeration material particles, comprising:

melting partially with a plasma a cylindrical alloy material which comprises La in a range of 4 to 15 atomic %, Fe in a range of 60 to 93 atomic %, Si in a range of 3.5 to 23.5 atomic % and at least one element M selected from B and Ti in a range of 0.5 to 1.5 atomic %, while rotating the cylindrical alloy materials;

separating the melted alloy into small pieces in a molten state by centrifugal force;

spheroidizing the melted alloy separated into the small pieces by the surface tension in an atmosphere;

solidifying the spheroidized small pieces in an atmosphere; and heat-treating the solidified small pieces to generate a $La(Fe, Si)_{13}$ phase, wherein the cylindrical alloy material comprises 55 volume % or more of a main phase which comprises α-Fe phase comprising Si, and a subphase which comprises intermetallic compound phase comprising La as a main component element and Si, and the main phase has a bcc crystal structure and an average grain diameter of 20 μm or less.

12. The method according to claim 11, wherein the solidified small pieces are subjected to the heat treatment under conditions of a temperature of 900 to 1100° C. for 12 to 240 hours.

13. The method according to claim 11, wherein the cylindrical alloy material has a diameter of 10 mm or more and a length of 100 mm or more.

14. The method according to claim 11, wherein the solidified small pieces comprise spherical particles having a diameter in a range of 0.3 to 1.2 mm.

15. The method according to claim 11, wherein the Fe is partially replaced by at least one element selected from Co, Ni and Mn.

16. The method according to claim 15, wherein the alloy material comprises Co in a range of 10 atomic % or less with respect to the whole alloy composition.

17. The method according to claim 11, wherein the La is partially replaced by at least one element selected from Ce, Pr and Nd.

* * * * *